US006445351B1

(12) United States Patent
Baker et al.

(10) Patent No.: US 6,445,351 B1
(45) Date of Patent: Sep. 3, 2002

(54) COMBINED OPTICAL SENSOR AND COMMUNICATION ANTENNA SYSTEM

(75) Inventors: Peter W. Baker, Gig Harbor; Chris Gulacsik, Bellevue; Marcus R. Gahler, Auburn; Arthur B. Dahlberg, Renton, all of WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/493,846

(22) Filed: Jan. 28, 2000

(51) Int. Cl.[7] ..... H01Q 21/30

(52) U.S. Cl. ..... 343/725; 343/781 CA; 343/909

(58) Field of Search ..... 343/721, 720, 343/781 CA, 725, 753, 909

(56) References Cited

U.S. PATENT DOCUMENTS

| | | | | | |
|---|---|---|---|---|---|
| 3,165,749 | A | | 1/1965 | Cushner | 343/911 R |
| 3,763,493 | A | | 10/1973 | Shimada et al. | 343/755 |
| 3,911,440 | A | | 10/1975 | Mizusawa | 343/755 |
| 3,968,497 | A | | 7/1976 | Bui Hai | 343/781 CA |
| 4,282,527 | A | | 8/1981 | Winderman et al. | 343/725 |
| 4,312,002 | A | | 1/1982 | Stewart | 343/725 |
| 4,339,757 | A | | 7/1982 | Chu | 343/781 P |
| 4,348,677 | A | | 9/1982 | Salmond | 343/729 |
| 4,477,814 | A | | 10/1984 | Brumbaugh et al. | 343/725 |
| 4,574,289 | A | | 3/1986 | Henderson | 343/786 |
| 4,636,797 | A | * | 1/1987 | Saffold et al. | 343/725 |
| 4,804,970 | A | * | 2/1989 | Todd | 343/753 |
| 4,866,454 | A | | 9/1989 | Droessler et al. | 343/725 |
| 4,933,928 | A | | 6/1990 | Grant et al. | 359/133 |
| 5,206,658 | A | | 4/1993 | Wokurka | 343/755 |
| 5,214,438 | A | * | 5/1993 | Brusgard | 343/725 |
| 5,298,909 | A | * | 3/1994 | Peters et al. | 343/720 |
| 5,327,149 | A | | 7/1994 | Kuffer | 343/720 |
| 5,351,060 | A | | 9/1994 | Bayne | 343/766 |
| 5,654,549 | A | | 8/1997 | Landecker et al. | 250/332 |

* cited by examiner

*Primary Examiner*—Don Wong
*Assistant Examiner*—Ephrem Alemu
(74) *Attorney, Agent, or Firm*—Christensen O'Connor Johnson Kindness PLLC

(57) ABSTRACT

The invention provides a combined optical sensor and communications antenna system (10). The system includes a primary reflector (12) for reflecting radiation. The primary reflector includes a centrally located core (14), which is adapted to transmit the radiation therethrough. An axis (18) centrally extending through the core forms an optical axis of the system. The system further includes a secondary reflector (16) positioned along the optical axis of the system for rereflecting and focusing the radiation reflected from the primary reflector toward the core of the primary reflector. The system still further includes a beam splitter (20) positioned adjacent the primary reflector on the opposite side from the secondary reflector, for separating and redirecting the radiation rereflected from the secondary reflector into an optical radiation component and a radiofrequency radiation component. Finally, the system includes a focal plane assembly (22) located adjacent the beam splitter to receive the optical radiation from the beam splitter, and a radiofrequency feed assembly (24) located adjacent the beam splitter to receive the radiofrequency radiation from the beam splitter.

21 Claims, 3 Drawing Sheets

COMBINED OPTICAL SENSOR AND COMMUNICATION ANTENNA SYSTEM

FIELD OF THE INVENTION

The present invention relates to a combination of an optical sensor and a communications antenna system, suitable for use in a spacecraft.

BACKGROUND OF THE INVENTION

A spacecraft consists of a plurality of sophisticated and reliable subsystems, including structures and mechanisms, power, attitude control, thermal control, payload sensors, and communications, all of which interact with each other to accomplish the intended mission of the spacecraft. The fewer the number of independent subsystems required to accomplish the intended mission, the higher the overall reliability of the spacecraft and the lower the volume, weight, and cost of the spacecraft. Thus, it is preferable to combine several subsystems into one, or to make a particular subsystem perform more than one function, in order to achieve a spacecraft that is more cost effective to design, produce, launch, and operate. Further, each subsystem, when combined, should maintain high capability and reliability so that the resulting spacecraft will meet the minimum overall capability and reliability. The present invention is directed to providing such a combination of subsystems, specifically, a combination of an optical sensor and a communications antenna system.

SUMMARY OF THE INVENTION

The invention provides a combined optical sensor and communications antenna system. The system includes a primary reflector for reflecting radiation. The primary reflector includes a centrally located core, which is adapted to transmit the radiation therethrough. An axis centrally extending through the core forms an optical axis of the system. The system further includes a secondary reflector positioned along the optical axis of the system for rereflecting and focusing the radiation reflected from the primary reflector toward the core of the primary reflector. The system still further includes a beam splitter positioned adjacent the primary reflector on the opposite side from the secondary reflector, for separating and redirecting the radiation rereflected from the secondary reflector into an optical radiation component and a radiofrequency radiation component. Finally, the system includes a focal plane assembly located adjacent the beam splitter to receive the optical radiation from the beam splitter, and a radiofrequency feed assembly located adjacent the beam splitter to receive the radiofrequency radiation from the beam splitter.

In one aspect of the present invention, the primary reflector includes a concave surface and the secondary reflector includes a convex surface. Preferably, the primary and secondary reflectors form a Ritchey-Chretien Cassegrain system.

In another aspect of the present invention, the beam splitter is formed of a dielectric material adapted to be substantially reflective in the frequency of the optical radiation and substantially transmissive in the frequency of the radiofrequency radiation, to separate the two radiation components.

In a further aspect of the invention, the radiofrequency feed assembly is a dual-band feed assembly. The dual-band feed assembly includes a box. Mounted within the box are a dichroic surface, a first horn antenna, and a second horn antenna. The dichroic surface is adapted to reflect the radiofrequency radiation of a first frequency band and to transmit the radiofrequency radiation of a second frequency band. The first horn antenna is adapted to receive the radiofrequency radiation of the first frequency band reflected from the dichroic surface, and the second horn antenna is adapted to receive the radiofrequency radiation of the second frequency band transmitted through the dichroic surface.

The present invention also provides a method of simultaneously receiving optical radiation and transceiving radiofrequency radiation. The method includes providing a primary reflector, as described, above, for receiving and reflecting optical and radiofrequency radiation. The method further includes providing a secondary reflector, also as described above, for rereflecting and focusing the optical and radiofrequency radiation reflected from the primary reflector toward the core of the primary reflector. The method still further includes providing a beam splitter adjacent the core of the primary reflector on the opposite side from the secondary reflector, for separating and redirecting the radiation rereflected from the secondary reflector into an optical radiation component and a radiofrequency radiation component. The method then processes the optical radiation received from the beam splitter to form an image. The method also processes the radiofrequency radiation received from the beam splitter to establish communication.

Accordingly, the present invention provides a combination of an optical sensor and a communications antenna system, without compromising each subsystem's capability and reliability. At the same time, by combining two subsystems into one, the present invention achieves an overall system that is more cost effective to design, produce, launch, and operate.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
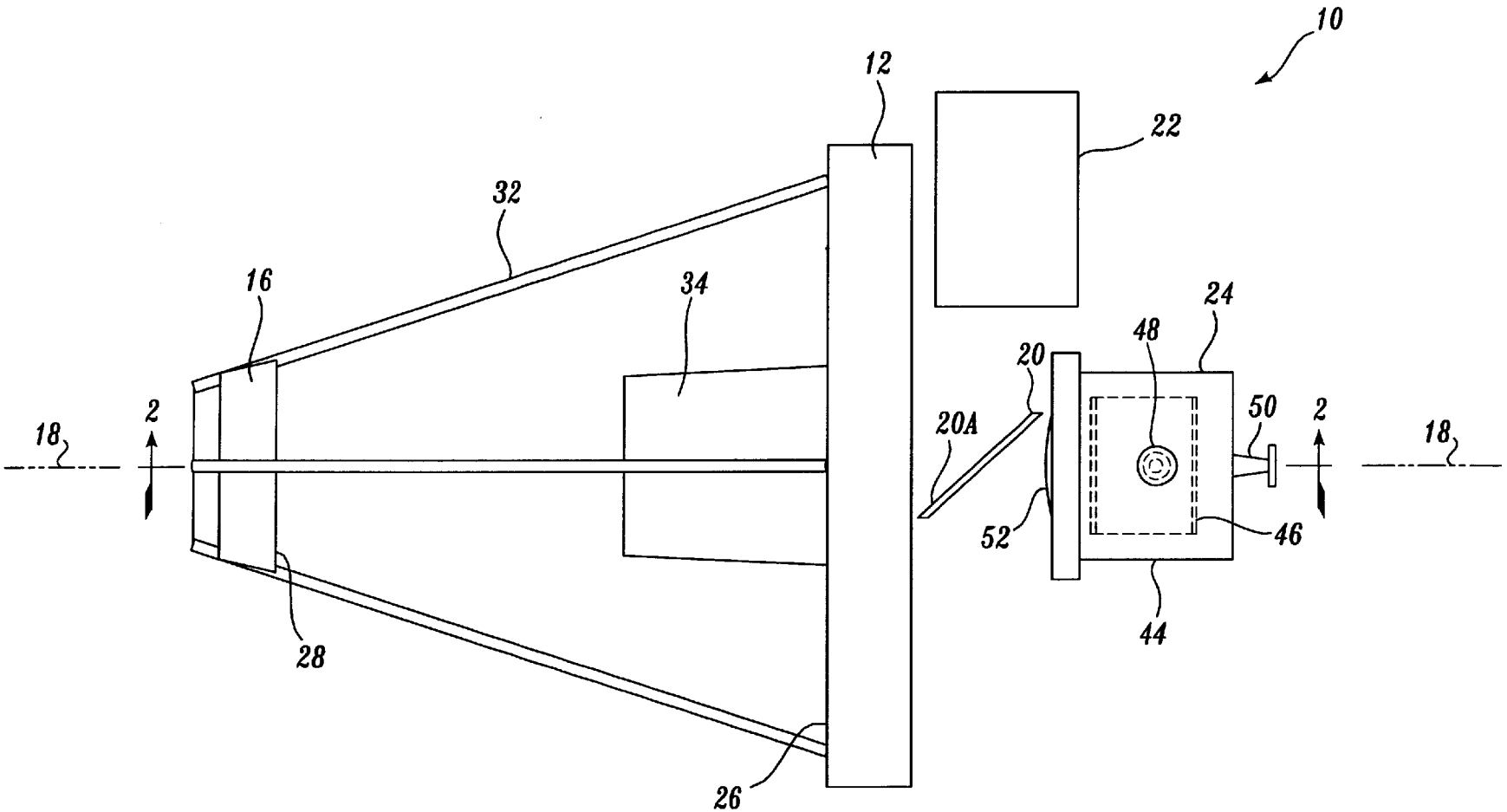
FIG. 1 is a side view of a combined optical sensor and communications antenna system in accordance with the present invention.
Figure 2:
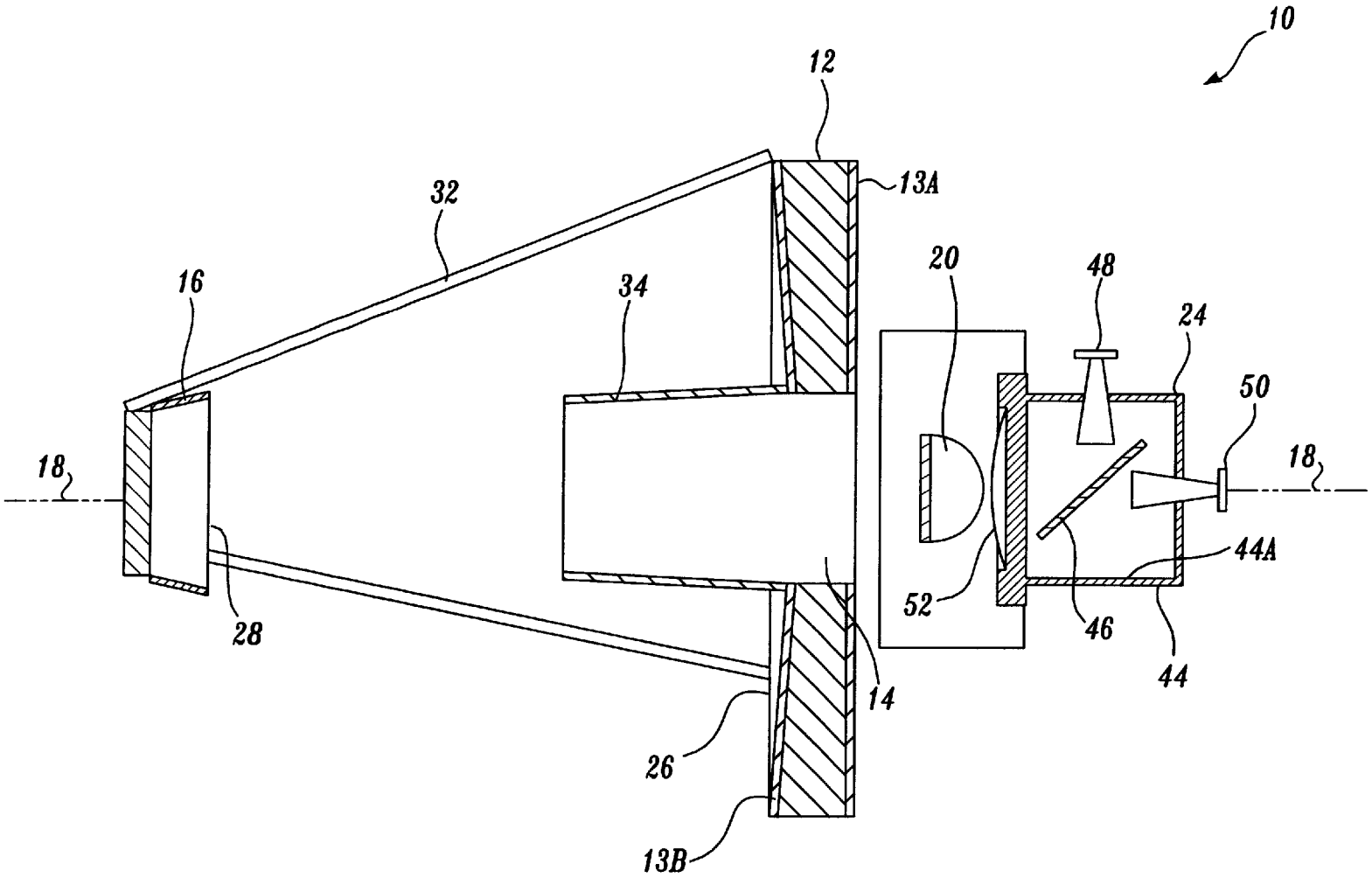
FIG. 2 is a partially cutaway cross-sectional view of the system taken along line 2—2 of FIG. 1.
Figure 3:
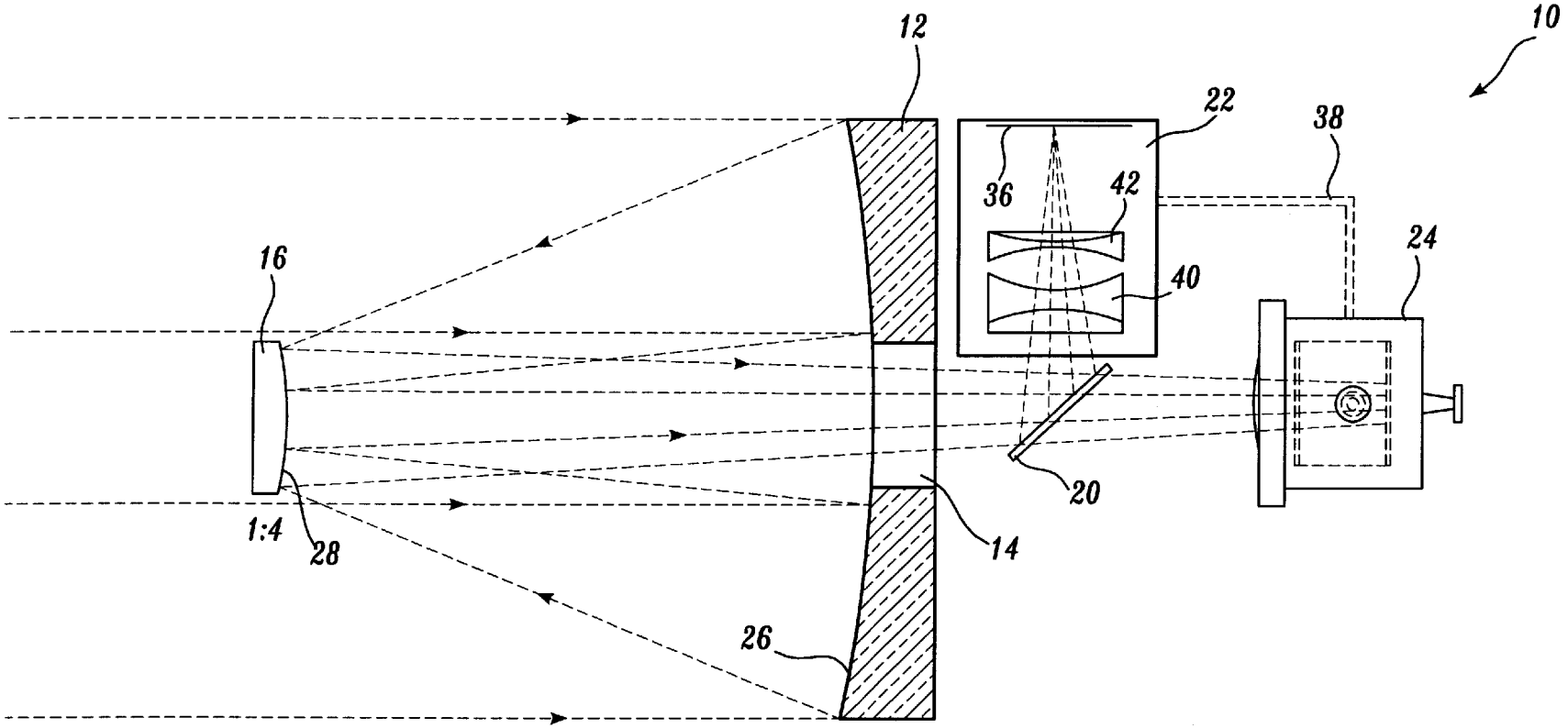
FIG. 3 is a partially cross-sectional side view of the system of claim 1, illustrating traveling paths of optical and radiofrequency radiation.

The present invention provides a system and method for simultaneously receiving optical radiation and transceiving radiofrequency radiation. Referring to FIGS. 1, 2, and 3, a combined optical sensor and communications antenna system 10 of the present invention include a primary reflector 12 for reflecting radiation, including both optical radiation and radiofrequency radiation. The primary reflector 12 includes a centrally located core 14 that is adapted to transmit the radiation. The system 10 further includes a secondary reflector 16 positioned along an optical axis 18 of the system 10 for rereflecting and focusing the radiation reflected from the primary reflector 12 toward the core 14 of the primary reflector 12, which transmits the radiation. The system 10 also includes a beam splitter 20 positioned adjacent the primary reflector 12 on the opposite side from the secondary reflector 16. The beam splitter 20 is adapted for separating and redirecting the radiation rereflected from the secondary reflector 16 and transmitted through the core 14 into the optical radiation component and the radiofrequency radiation component. The system 10 still further includes a focal plane assembly 22 located adjacent the beam splitter 20 and adapted to receive the optical radiation therefrom. The system 10 finally includes a radiofrequency feed assembly 24 located adjacent the beam splitter 20 and adapted to receive the radiofrequency radiation therefrom.

It is to be noted that the combined optical sensor and communications antenna system 10 described above obeys the law of reciprocity; what is described about receiving radiation applies to transmitting radiation in a reverse order, as more fully described below.

In the present description, the term "optical radiation" is used to indicate radiation ranging from infrared through visible to ultraviolet. "Radiofrequency radiation" is used to indicate radiation that is typically used in communication, including microwave frequencies ranging from approximately 20 GHz to 100 GHz. The term "radiation" refers to a wide range of electromagnetic radiation including both the optical radiation and the radiofrequency radiation.

The primary reflector 12 and the secondary reflector 16 are constructed of any suitable material, which is relatively lightweight and has superior thermal stability, such as low-expansion glass. One preferred material especially for forming the relatively large primary reflector 12 is hollowed-out core material, such as honeycomb- or lattice-like material, sandwiched between two face sheets 13*a*, 13*b* made of, for example, low-expansion glass. Thus constructed, the primary reflector 12 is made sufficiently light weight and, yet, provides sufficient structural stability due to the face sheets 13*a*, 13*b*. Surfaces 26, 28 of the primary and secondary reflectors 12, 16, respectively, comprise a conic section, i.e., paraboloidal, hyperboloidal, etc. Both of the surfaces 26, 28 are coated with metal, such as aluminum or silver, which are highly reflective at both the optical frequency band and the radiofrequency band. Moreover, additional dielectric layers, such as silicon dioxide, may be applied over the metal coating on the surfaces 26, 28 to enhance their reflectively, as known in the art. The centrally located core 14 of the primary reflector 12 is a hollow bore defined through the primary reflector 12 to transmit both the optical and radiofrequency radiation therethrough.

In one preferred embodiment, the surface 26 of the primary reflector 12 is concave and the surface 28 of the secondary reflector 16 is convex, and the two reflectors 12, 16 are supported by a frame 32 to form a Cassegrain reflector system. The most preferred embodiment is a Ritchey-Chretien Cassegrain system. The Ritchey-Chretien Cassegrain system is characterized as being formed of two hyperboloidal reflectors. The Ritchey-Chretien Cassegrain system is generally preferred for imaging applications because the system's reflector shapes are chosen to correct both coma and spherical aberrations. Alternatively, however, the primary and secondary reflectors 12, 16 may be arranged as in any other telescopic optical system, such as a classical Cassegrain system that is designed to transmit radiation from the primary reflector 12 to the secondary reflector 12, then to the core 14 of the primary reflector 12.

Preferably, a cylindrical baffle 34 is coaxially mounted to the surface 26 of the primary reflector 12. The baffle 34 has an inner diameter that is equal to or slightly greater than the diameter of the core 14, so as to encircle the core 14 of the primary reflector 12. The baffle 34 blocks radiation other than the radiation rereflected from the secondary reflector 16 so that only the radiation rereflected from the secondary reflector 16 will be transmitted through the core 14. In particular, the baffle 34 prevents radiation from directly entering the central core 14 without first being reflected by the primary reflector 12.

The beam splitter 20 is arranged adjacent the core 14 to receive the radiation rereflected and converged by the secondary reflector 16. (See FIG. 3.) The beam splitter 20 is formed of any rigid dielectric frame and mechanically supported at its periphery by any suitable structure extending from the primary mirror 12. On a surface 20*a* of the rigid dielectric frame facing the primary reflector 12, a coating is applied that is highly reflective (more than approximately 85% reflective, for example) in the optical frequency band and highly transmissive (more than approximately 85% transmissive, for example) in the radiofrequency band. Such coating may be formed by applying multiple layers of dielectric material having different dielectric constant on the rigid dielectric frame, as known in the art. By reflecting the majority of the optical radiation while transmitting the majority of the radiofrequency radiation, the beam splitter 20 effectively separates and redirects the two types of radiation to the focal plane assembly 22 and the radiofrequency feed assembly 24, respectively. It should be noted that the threshold transmission rate or reflection rate is not limited to 85%, and may vary depending on the requirements of each application.

To optimize the radiation separation, it may be preferable to arrange the beam splitter 20 so that its surface 20*a* is at approximately 45° relative to the optical axis 18 of the present system 10, as illustrated. In such a case, as most clearly illustrated in FIG 3, the path along which the optical radiation is directed from the beam splitter 20 to the focal plane assembly 22 and the path along which the radiofrequency radiation is directed from the beam splitter 20 to the radiofrequency feed assembly 24 are generally orthogonal to each other. However, other angles are also possible depending on the available space and configuration limitations of a particular application, as long as the beam splitter 20 serves to separate and redirect the radiofrequency radiation and the optical radiation.

Alternatively, the coating may be formed so as to be highly reflective instead in the radiofrequency band and highly transmissive in the optical frequency band, to separate and redirect the two types of radiation. In this case, naturally, the positions of the focal plane assembly 22 and the radiofrequency feed assembly 24 will be switched from those shown in FIGS. 1 and 3.

The focal plane assembly 22 is arranged adjacent the beam splitter 20 to receive the optical radiation separated and redirected by the beam splitter, and is mounted to any suitable structure extending from the primary mirror 12. The focal plane assembly 22, in combination with the primary and secondary reflectors 12, 16 and the beam splitter 20, gathers light for spectroscopy or to create imagery to be transmitted. Specifically, referring to FIG. 3, the focal plane assembly 22 includes an array of photodetectors arranged at a focal plane 36 to register an image transmitted via the optical radiation. The image is then converted into electrical signals and processed, for example, coupled to radiofrequency signals via a line 38 for transmission. The process of image formation and coupling of optical and radiofrequency signals is well known in the art and, thus, is not described in detail in the present description.

As noted above, the most preferred optical system suitable for the present invention is a Ritchey-Chretien Cassegrain system. In one specific configuration of a Ritchey-Chretien Cassegrain system suitable for use in the present invention, the primary reflector 12 has a diameter of approximately 24 inches and a focal ratio of f/1.2, and the secondary reflector 16 has a diameter of about 6 inches (¼ of that of the primary reflector 12). The combination of these primary and secondary reflectors has an effective focal length of 132 inches, which may be lengthened to provide a proper-sized image on the focal plane 36. This can be accomplished by arranging a suitable focal extender 40, commonly known as a Barlow lens group, between the beam splitter 20 and the focal plane 36 to increase the effective focal length of the combination of the reflectors 12, 16. (See FIG. 3.) Additionally, it is well known that the Ritchey-Chretien Cassegrain has strong field curvature. To mitigate this problem, a field flattener lens group 42 may be arranged between the beam splitter 20 and the focal plane 36 to flatten the field curvature, i.e., to ensure sharp, in-focus image formation on the focal plane 36.

In the above example, the secondary reflector 16 has a diameter that is approximately ¼ of the diameter of the primary reflector 12. It has been found that the ¼ (25%) obstruction ratio (the ratio of the diameter of the secondary reflector 16 to the diameter of the primary reflector 12) does not reduce contrast performance of the image formed on the focal plane 36. Further, a larger obstruction ratio may be used without significantly degrading imaging system performance.

The radiofrequency feed assembly 24 is positioned adjacent the beam splitter 20 to receive the radiofrequency radiation separated by the beam splitter 20, and is mounted to any suitable structure extending from the primary mirror 12. The radiofrequency feed assembly 24, in combination with the primary and secondary reflectors 12, 16 and the beam splitter 20, receives and transmits the radiofrequency radiation to achieve radiofrequency communication, for example, space-to-ground high-data-rate communication.

The radiofrequency feed assembly 24 may be any suitable single-frequency band system. Alternatively, the assembly 24 may be a dual-frequency band system to achieve frequency reuse, as known in the art.

In the illustrated embodiment adapted for dual-band communication, the radiofrequency feed assembly 24 of the present invention includes a frame box 44. Supported within the frame box 44 is a dichroic surface 46, which is arranged to receive the radiofrequency radiation separated by the beam splitter 20. The dichroic surface 46 is adapted to be highly reflective in a first radiofrequency band and highly transmissive in a second radiofrequency band. Typically, the dichroic surface 46 is formed of layers of dielectric materials and a pattern of thin metal (patterned metalization) provided on the surface of the dielectric layers, adapted to separate one band of radiofrequency radiation from yet another band of radiofrequency radiation, as well known in the art. Because the dichroic surface 46 thus constructed has no constraint on radiation polarization, use of the dichroic surface to separate two radiofrequency bands allows for complete polarization diversity and, thus, signal loss will be minimal.

The radiofrequency feed assembly 24 further includes a first horn antenna 48 and a second horn antenna 50. The first horn antenna 48 is positioned to receive the radiofrequency radiation of the first band reflected from the dichroic surface 46, and the second horn antenna 50 is positioned to receive the radiofrequency radiation of the second band transmitted through the dichroic surface 46. The first and second horn antennas 48, 50 then process the received radiofrequency radiation in any conventional manner. To optimize the radiation separation process, preferably, the dichroic surface 46 is arranged so that it is at approximately 45° relative to the optical axis 18 of the present system 10. Accordingly, the first and second horn antennas 48, 50 should be arranged generally orthogonal to each other. Additionally, an inner wall 44*a* of the frame box 44 is preferably lined with a radiofrequency radiation absorber, to further prevent multiple reflections on the inner wall 44 and to effectively eliminate cross-coupling between the first and second horn antennas 48, 50.

In the case of radiofrequency radiation transmission, the propagation path of the radiation heretofore described is reversed. Specifically, radiofrequency signals of the first band are emitted from the first horn antenna 48 toward the dichroic surface 46, reflected therefrom toward the beam splitter 20, transmitted therethrough toward the secondary reflector 16, reflected therefrom toward the primary reflector 12, and reflected therefrom toward space. Radiofrequency signals of the second band are emitted from the second horn antenna 50 toward the dichroic surface 46, transmitted therethrough toward the beam splitter 20, transmitted therethrough toward the secondary reflector 16, reflected therefrom toward the primary reflector 12, and reflected therefrom toward space. As noted above, optical frequency signals acquired in the focal plane assembly 22 may be coupled to the radiofrequency signals of the first or second band via the line 38, and transmitted via the first and second horn antenna antennas 48, 50.

For any given beamwidth (for example a 10 dB beamwidth of approximately 10° to obtain an useful downlink in a spacecraft application), an antenna used to collect and transmit radiation should have the largest feasible collection area, or aperture, to maximize the antenna's gain. In the illustrated embodiment of the present invention, thus, the diameter of the primary reflector 12 (aperture) is made sufficiently large relative to the diameter of the secondary reflector 16, while ensuring that the radiation reflected from the primary reflector 12 maximizingly illuminates the secondary reflector 16. The radiation collected across the relatively large aperture generally has uniform radiation phase, and processing of such radiation requires a relatively long feed horn that allows for achieving nearly constant radiation phase across the feed horn aperture. Use of a relatively long feed horn, however, is not always feasible. For example, in spacecraft applications, a radiofrequency feed assembly 24 should be formed to be compact and lightweight and, thus, use of a relatively long, voluminous horn antenna is not desirable. To address this problem, in accordance with the present invention, the radiofrequency feed assembly 24 may further include a lens 52 arranged adjacent and incident to the dichroic surface 46. The lens 52 is adapted to decrease the beamwidth of the radiofrequency radiation transmitted through the beam splitter 20 to form a quasi-columnar beam with uniform radiation phase, thereby allowing for use of a shorter horn antenna. Preferably, the lens 52 is formed of dielectric low-loss material, such as cynate-ester, to reduce radiation losses. With the arrangement of the lens 52, therefore, shorter horn antennas 48, 50 and, hence, more compact and lightweight radiofrequency feed assembly 24 can be achieved.

As described above, the present invention provides a combination of an optical sensor and a communications antenna system, without compromising each subsystem's capability and reliability. At the same time, by combining two subsystems into one, the present invention achieves an overall system that is more cost effective to design, produce, launch, and operate.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A combined potical sensor and communications antenna system, comprising:

a primary reflector for reflecting radiation, the primary reflector including a centrally located core, the core being adapted to transmit the radiation, an axis extending through the core forming an optical axis of the system;

a secondary reflector positioned along the optical axis of the system for rereflecting and focusing the radiation reflected from the primary reflector toward the core of the primary reflector;

a beam splitter positioned adjacent the primary reflector on the opposite side from the secondary reflector, the beam splitter being adapted for separating and redirecting the radiation rereflected form the secondary reflector into an optical radiation component along a first path and a radiofrequency radiation component along a second path;

a focal plane assembly located adjacent the beam splitter and comprising an array of photodetectors, the focal plane assembly being configured to receive the optical radiation from the beam splitter along the first path, the focal plane assembly being further configured to form an image based on the optical radiation received and registered to the array of photodetectors; and a radiofrequency feed assembly located adjacent the beam splitter, the assembly being configured to receive the radiofrequency radiation from the beam splitter along the second path to establish radiofrequency communication, the radiofrequency feed assembly being further configured to transmit radiofrequency radiation;

wherein the first path and the second path are generally orthogonal to each other.

2. The system of claim 1, wherein a frequency of the optical radiation ranges between infrared through ultraviolet, and a frequency of the radiofrequency radiation includes a microwave frequency ranging from approximately 20 GHz to 100 GHz.

3. The system of claim 1, wherein the primary reflector comprises a concave surface and the secondary reflector comprises a convex surface.

4. The system of claim 3, wherein the primary and secondary reflectors form a Ritchey-Chretien Cassegrain system.

5. The system of claim 4, wherein the focal plane assembly includes a field flattener.

6. The system of claim 1, wherein the focal plane assembly includes a focal extender.

7. The system of claim 1, wherein the primary and secondary reflectors are formed in a shape selected from a group consisting of conic sections.

8. The system of claim 1, wherein a plane of the beam splitter is disposed at approximately 45° relative to the optical axis of the system.

9. The system of claim 1, wherein the beam splitter comprises a dielectric material adapted to be substantially reflective in the frequency of the optical radiation and substantially transmissive in the frequency of the radiofrequency radiation.

10. The system of claim 1, wherein the radiofrequency feed assembly comprises a dual-band feed assembly including a box, mounted within the box are a dichroic surface, a first horn antenna, and a second horn antenna, the dichroic surface being adapted to reflect a radiofrequency radiation of a first frequency band and to transmit radiofrequency radiation of a second frequency band, the first horn antenna being adapted to receive the radiofrequency radiation of the first frequency reflected from the dichroic surface, and the second horn antenna being adapted to receive the radiofrequency radiation of the second frequency transmitted through the dichroic surface.

11. The system of claim 10, wherein the radiofrequency feed assembly further comprises a dielectric lens positioned incident to the dichroic surface, the lens being adapted to decrease the beamwidth to thereby increase the phase uniformity of the radiofrequency radiation transmitted through the beam splitter.

12. The system of claim 10, wherein the dichroic surface is disposed at approximately 45° relative to the optical axis of the system.

13. The system of claim 10, wherein a longitudinal axis of the first horn antenna and a longitudinal axis of the second horn antenna are arranged orthogonal to each other.

14. The system of claim 10, wherein the box is lined with radiofrequency radiation absorber.

15. A method of simultaneously receiving optical radiation and transceiving radiofrequency radiation, comprising:

providing a primary reflector for receiving and reflecting optical and radiofrequency radiation, the primary reflector including a centrally located core, the core being adapted to transmit the optical and radiofrequency radiation, axis extending through the core forming an optical axis of the primary reflector;

providing a secondary reflector positioned along the optical axis of the primary reflector for rereflecting and focusing the optical and radiofrequency radiation reflected from the primary reflector toward the core of the primary reflector;

providing a beam splitter positioned adjacent the core of the primary reflector on the opposite side from the secondary reflector, the beam splitter being adapted for separating and redirecting the radiation rereflected from the secondary reflector into an optical radiation component along a first path and a radiofrequency radiation component received form the beam splitter along the first path;

forming an image by processing the optical radiation component received from the beam splitter along the first path;

established communication by processing the radiofrequency radiation component received from the beam splitter along the first path;

wherein the first path and the second path are generally orthogonal to each other.

16. The method of claim 15, wherein a frequency of the optical radiation ranges between infrared through ultraviolet, and a frequency of the radiofrequency radiation includes a microwave frequency ranging from approximately 20 GHz to 100 GHz.

17. The method of claim 15, wherein processing of the optical radiation comprises extending a focal length of the optical radiation received from the beam splitter.

18. The method of claim 15, wherein the optical radiation and the radiofrequency radiation separated by the beam splitter travel in directions generally orthogonal to each other.

19. The method of claim 15, wherein processing of the radiofrequency radiation comprises separating radiofrequency radiation of a first frequency band from radiofrequency radiation of a second frequency band, and processing the first and second frequency bands radiofrequency radiation respectively.

20. The method of claim 15, wherein processing of the radiofrequency radiation comprises decreasing a beamwidth of the radiofrequency radiation to thereby increase the phase uniformity of the radiofrequency radiation transmitted through the beam splitter.

21. The system of claim 1, wherein the image formed by the focal plane assembly is coupled to the radiofrequency radiation transmitted by the radiofrequency feed assembly.

* * * * *

UNITED STATES PATENT AND TRADEMARK OFFICE

CERTIFICATE OF CORRECTION

PATENT NO. : 6,445,351 B1
DATED : September 3, 2002
INVENTOR(S) : P.W. Baker et al.

It is certified that error appears in the above-identified patent and that said Letters Patent is hereby corrected as shown below:

Title page, Item [54] and Column 1, lines 1-2,
Title, "COMBINED OPTICAL SENSOR AND COMMUNICATION ANTENNA SYSTEM" should read -- COMBINED OPTICAL SENSOR AND COMMUNICATIONS ANTENNA SYSTEM --

Column 7,
Line 11, "potical" should read -- optical --
Line 24, "rereflected form" should read -- rereflected from --

Column 8,
Lines 49-50, "component received form the beam splitter along the first path;" should read -- component along a second path; --
Line 55, "established" should read -- establishing --
Line 57, "first path;" should read -- second path; --

Column 9,
Line 9, "bands radiofrequency" should read -- bands' radiofrequency --

Signed and Sealed this

Twenty-fifth Day of February, 2003

JAMES E. ROGAN
*Director of the United States Patent and Trademark Office*